US005909745A

United States Patent [19]

Ali et al.

[11] Patent Number: 5,909,745

[45] Date of Patent: Jun. 8, 1999

[54] USE OF CARBON DIOXIDE AND CARBONIC ACID TO CLEAN CONTACT LENSES

[75] Inventors: Yusuf Ali, Stow, Ohio; Rajkumar Bhatia; Alok K. Kulshreshtha, both of Arlington, Tex.

[73] Assignee: Alcon Laboratories, Inc., Fort Worth, Tex.

[21] Appl. No.: 09/099,669

[22] Filed: Jun. 18, 1998

Related U.S. Application Data

[63] Continuation-in-part of application No. 08/806,571, Feb. 25, 1997, abandoned

[60] Provisional application No. 60/012,274, Feb. 26, 1996.

[51] Int. Cl.[6] ..... C11D 3/10

[52] U.S. Cl. ..... 134/42; 134/424

[58] Field of Search ..... 134/6, 902, 42, 134/7, 26, 40; 510/112; 424/29

[56] References Cited

U.S. PATENT DOCUMENTS

| | | | |
|---|---|---|---|
| 4,361,536 | 11/1982 | Leopardi | 422/33 |
| 4,533,399 | 8/1985 | Mencke | 134/6 |
| 4,543,200 | 9/1985 | Sherman | 252/106 |
| 4,814,109 | 3/1989 | Wittpenn, Jr. et al. | 252/547 |
| 4,908,147 | 3/1990 | Tsao et al. | 252/106 |
| 5,185,161 | 2/1993 | Davidson et al. | 424/665 |
| 5,384,091 | 1/1995 | Rontome et al. | 422/30 |
| 5,491,091 | 2/1996 | Loshaek et al. | 436/1 |
| 5,576,276 | 11/1996 | Tsao et al. | 510/112 |
| 5,696,171 | 12/1997 | Rupp et al. | 514/700 |
| 5,756,044 | 5/1998 | Mowrey-McKee et al. | 422/28 |
| 5,783,532 | 7/1998 | Huth | 510/114 |

FOREIGN PATENT DOCUMENTS

| | | |
|---|---|---|
| 93784A | 4/1982 | European Pat. Off. . |
| 57-048712 A | 3/1982 | Japan . |
| 63-2464518 A | 11/1988 | Japan . |
| 01179123 A | 7/1989 | Japan . |
| WO94/19027 | 9/1994 | WIPO . |
| WO 96/20376 | 7/1996 | WIPO . |

*Primary Examiner*—Jill Warden
*Assistant Examiner*—Yolanda E. Wilkins
*Attorney, Agent, or Firm*—Patrick M. Ryan

[57] ABSTRACT

Simple, efficacious, easily manufacturable, convenient to use and cost-effective contact lens care cleaning compositions comprising carbon dioxide and carbonic acid as cleansing agents are disclosed. The compositions do not require abrasive agents such as polymeric beads, nor ocularly irritating agents such as enzymes or surfactants in order to effectively clean proteinaceous and nonproteinaceous deposits from the surface of contact lenses. Also disclosed is a one-step cleaning and disinfecting regimen, whereby an effervescent tablet composition capable of generating carbon dioxide and carbonic acid is dissolved in a disinfecting solution or rinsing/disinfecting/storage solution.

13 Claims, 1 Drawing Sheet

USE OF CARBON DIOXIDE AND CARBONIC ACID TO CLEAN CONTACT LENSES

This application is a continuation-in-part of Ser. No. 08/806,571, filed Feb. 25, 1997 now abandoned, which claims priority from provisional application, Ser. No. 60/012,274, filed Feb. 26, 1996.

BACKGROUND OF THE INVENTION

1. Field of the Invention

The present invention relates to contact lens cleaning methods and compositions. In particular, this invention relates to the use of carbon dioxide and carbonic acid to clean contact lenses.

2. Description of Related Art

Numerous contact lens care cleaning compositions are known. Contact lens cleaning products typically contain polymeric beads, enzymes, surfactants, or some combination thereof, as cleansing ingredients. Repeated use of cleaning compositions containing polymeric beads, such as Teflon or silicon dioxide beads, can damage the surface of contact lenses. Additionally, if all polymeric beads are not rinsed from the lens before inserting the lens in the eye, any residual beads may irritate the eye.

Enzymatic cleaners are popular cleansing agents for contact lenses, particularly for their ability to remove protein deposits. Raw material control for both enzymes and polymeric beads is often difficult. As in the case of polymeric beads, enzymes can be irritating to the eye if not thoroughly rinsed from the contact lens before it is inserted. Enzyme-containing cleaning products also suffer the disadvantage that they are generally incapable of being sterilized with heat, as the high temperatures required for sterilization can chemically degrade enzymes.

Surfactants are typically ineffective for cleaning protein deposits and are also generally irritating to the eye.

JP 01179123A (890717) discloses contact lens cleaning compositions containing percarbonate and an anionic or nonionic surfactant. The reaction of percarbonate with water generates oxygen bubbles. The reference attributes the cleaning to the mechanical cleaning action of the bubbles and the chemical cleaning action of the surfactant.

EP 93784A (831116) discloses enzymatic cleaning compositions for contact lenses. The cleaning compositions are comprised of an effervescent tablet containing trypsin, alpha-amylase, lipase, citric acid, sodium bicarbonate, calcium acetate and EDTA.

JP 88059123B (881117) discloses a foaming, contact lens cleaning tablet composition containing sodium bicarbonate, an organic or inorganic acid (or salt thereof, an enzyme, and a surfactant. When combined with clean water, the reference tablet foams, removing stains from the surface of contact lenses by the physical action of the foam. After foaming, remaining stains are removed by the enzyme and the surfactant.

Therefore, it is highly desirable to have lens care cleaning compositions which are capable of effectively cleaning proteinaceous and nonproteinaceous deposits from lenses, but which do not require the presence of polymeric beads, enzymes or cleansing amounts of surfactants.

SUMMARY OF THE INVENTION

The present invention provides contact lens care cleaning compositions comprising a cleansing amount of carbon dioxide and carbonic acid, or which are capable of generating a cleansing amount of carbon dioxide and carbonic acid. Because the compositions of the present invention do not require polymeric beads, enzymes or cleansing amounts of surfactants, they are much less likely to damage the surface of a contact lens or cause ocular irritation.

The present invention also provides a simple method of cleaning contact lenses. The method comprises contacting the lens in need of cleaning with carbon dioxide and carbonic acid for a time sufficient to achieve effective cleaning.

In the most preferred embodiment, the present invention provides a one-step cleaning and disinfecting system for contact lenses. A cleaning and disinfecting solution is prepared by dissolving an effervescent tablet in an ophthalmically acceptable disinfecting solution at a pH of less than about 7.5 such that carbon dioxide and carbonic acid are generated, and then the soiled contact lens is contacted with the resulting solution for a time sufficient to achieve effective cleaning and disinfection in a single step.

Among other factors, the present invention is based on the finding that soiled contact lenses can be effectively cleaned by compositions comprising a cleansing amount of carbon dioxide and carbonic acid, without the need for additional cleaning agents, such as polymeric beads, surfactants or enzymes, typically present in the contact lens care cleaning compositions currently marketed.

DETAILED DESCRIPTION OF THE INVENTION

Figure 1:
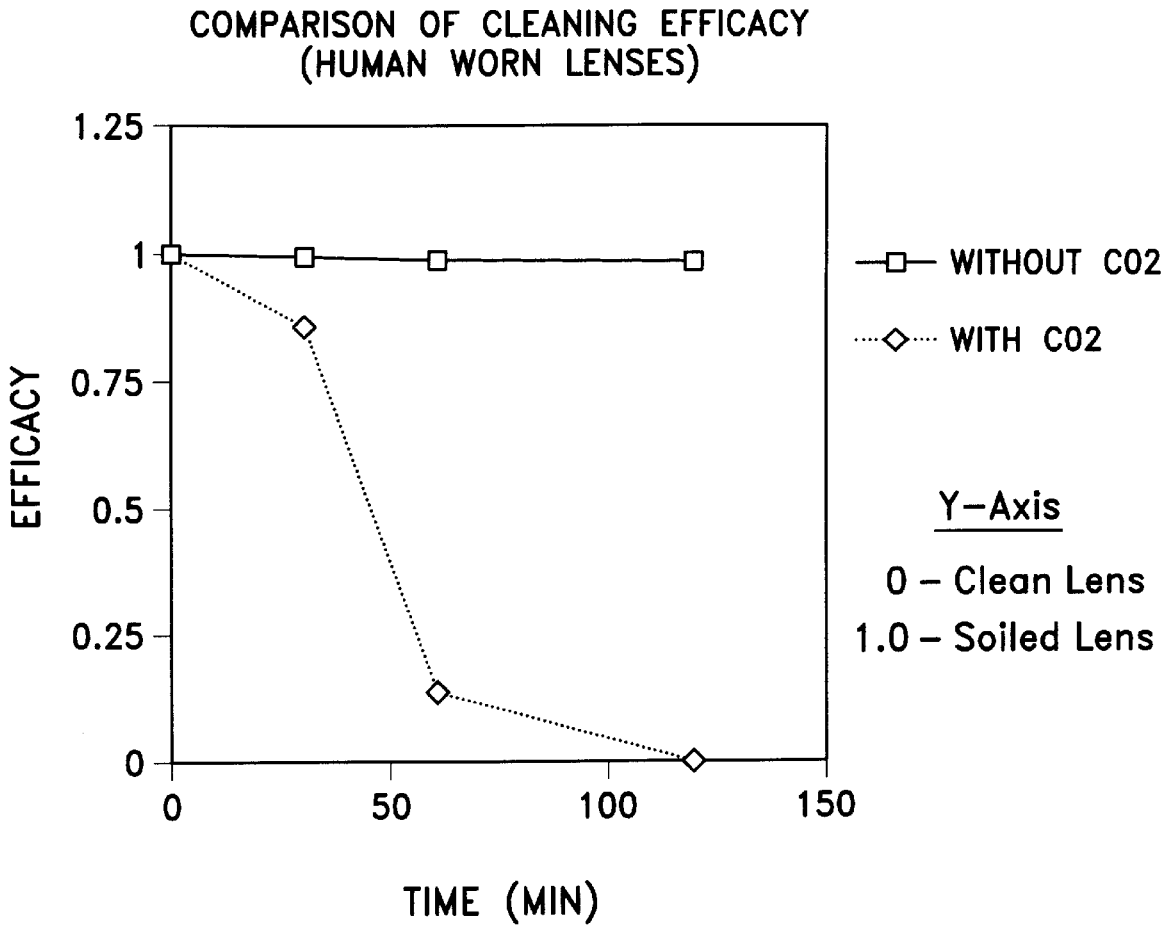
FIG. 1 shows a comparison of the cleaning efficacy of cleaning solutions (with and without carbon dioxide).

The contact lens cleaning compositions of the present invention comprise a cleansing amount of carbon dioxide and carbonic acid. Such compositions may contain carbon dioxide and carbonic acid in their final, packaged formulation, as in the case of compositions containing compressed carbon dioxide and water in a pressurized container. Alternatively, the compositions of the present invention may be formulated to generate carbon dioxide and carbonic acid to clean contact lenses. For example, effervescent tablets may be prepared which, upon dissolution in water or saline solution at a pH of less than about 7.5, generate a cleansing amount of carbon dioxide and carbonic acid. Compositions of the latter type are preferred for their consumer convenience, ease of manufacture, simple packaging requirements and cost.

Because the compositions of the present invention do not require enzymes to effectively clean soiled contact lenses, they may be sterilized using conventional gamma irradiation sterilization techniques. When combined with a disinfecting solution or a rinsing, disinfecting and storage solution, the burden upon the disinfectant is lower in the case of the cleaning compositions of the present invention than in the case of conventional enzyme-containing cleaning compositions.

In a preferred embodiment of the present invention, the composition of the present invention is prepared in the form of an effervescent tablet. As those skilled in art appreciate, the effervescent tablet must contain a basic component and an acidic component, so that upon dissolution appropriate reactions occur to generate carbon dioxide and carbonic acid. Suitable effervescent components include the carbonate family of basic compounds and inorganic or organic acidic compounds.

Among the carbonate family of basic compounds, preferred effervescent components for use in the compositions of the present invention are sodium carbonate, sodium bicarbonate, glycine carbonate, potassium carbonate, potassium bicarbonate, potassium dihydrogencitrate, and calcium carbonate. Most preferred is sodium bicarbonate.

Preferred acidic components for use in the compositions of the present invention are citric acid, adipic acid, tartaric acid, maleic acid, boric acid, benzoic acid, hydroxybenzoic acid, methoxybenzoic acid, mandelic acid, malonic acid, lactic acid, pyruvic acid, glutaric acid, aspartic acid, hydrochloric acid, oxalic acid, salicylic acid, succinic acid, and acetic acid. The most preferred acidic effervescent components are citric acid and adipic acid, and combinations of these two acids.

As those skilled in the art appreciate, the amounts of the basic and acidic components required in the compositions of the present invention to generate an amount of carbon dioxide and carbonic acid sufficient to clean a soiled contact lens will depend on a number of factors, including the particular basic and acidic components chosen, the period of time available for cleaning, the type and extent of the deposits on the soiled lens to be cleaned, etc. Generally, however, the amount of carbon dioxide required will be at least 5 mg or more.

In the case of sodium bicarbonate and citric acid, the amount of the basic component will typically be from 10 to 200 mg, and the amount of the acidic component will typically be from 5 to 65 mg. Particularly if acidic and basic component concentrations in the lower portion of these ranges are employed, additional ingredients, such as sodium chloride, mannitol, sorbitol, glucose, fructose or lactose, can be added to the basic and acidic effervescent components as fillers, excipients, bulking agents or tonicity agents.

Without being bound to any theory, it is believed that $CO_2$ produced from the reaction between the acidic and basic effervescent components of the tablet compositions of the present invention in the presence of water generates carbonic acid.

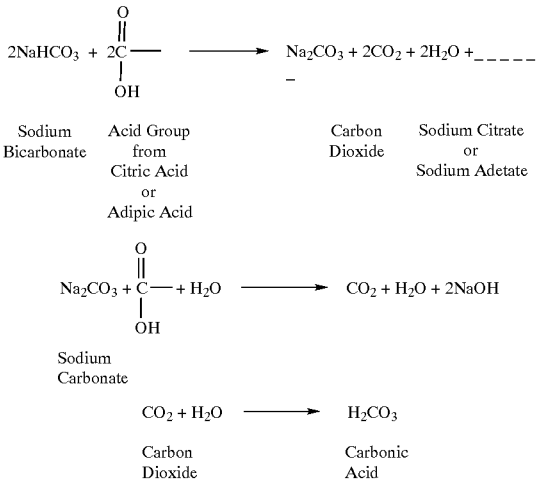

In some cases, it is desirable to include a lubricant in effervescent tablet compositions in order to facilitate the manufacture of tablets. Suitable lubricants and their typical concentrations (in weight percent based on total tablet composition) include polyethylene glycol 3,350 (0.05–10%); polyethylene glycol 8,000 (1–10%); sodium benzoate (1–10%); vegetable oils (1–4%); talc (1–5%); boric acid (0.5–5%); and sodium borate (0.5–5%). The preferred lubricant for use in the tablet compositions of the present invention is polyethylene glycol 3,350.

In addition to the basic and acidic effervescent tablet ingredients described above, the tablet composition of the present invention may also contain other excipients conventionally employed in ophthalmic tablet compositions such as lactose anhydrous, lactose, mannitol, sorbitol, glucose, fructose; compressible sugar; or sodium chloride. Sodium chloride can be used to adjust the tonicity of the tablet in order to cause the solution resulting from the dissolution of the tablet to be isotonic. Though it is not an essential ingredient, the preferred tablet compositions of the present invention may contain lactose anhydrous as a filler. As mentioned above, however, the tablet compositions do not contain polymeric beads, an enzyme, or cleansing amounts of surfactants. The compositions do not contain a disinfecting amount of hydrogen peroxide.

The tablet compositions of the present invention are obtained using tableting procedures known in the art. Generally, the tableting procedures may be summarized as follows.

1. The formulation ingredients are weighed and sized using an oscillating granulator with an 18 to 40 mesh screen (may use any of 18, 20, 26, 30, 33 or 40 mesh screen).
2. The materials are then blended using a twin shell P-K blender until uniform (generally about 30 minutes or less). Alternatively, a cone blender may be used.
3. Tablets are compressed using suitable tooling on a suitable tablet press.
4. Tablet weight can be adjusted from about 35 to 300 mg (a preferred tablet weight is about 73 mg).
5. The tablet hardness ranges from 2 to 8 strong cobb units.
6. Tablets are then pressed and strip packaged.
7. The strip packaged tablets can then be sterilized using y (gamma) irradiation.

The effervescent tablet compositions of the present invention may be dissolved in purified water or a simple saline solution in a contact lens holder (such as a 5 mL plastic vial). The soiled contact lens may be placed in the lens holder containing purified water or saline solution prior to, or just after, the effervescent tablet is added to the holder. Once the tablet is dissolved, typically in about 60 seconds or less, the soiled contact lens is contacted with the resulting solution for a time sufficient to achieve effective cleaning. The pH of the resulting solution is less than about 7.5. The time required for effective cleaning will vary depending upon the type and extent of deposits on the lens, etc., but is generally less than about 4 hours and preferably less than about 1 hour.

In one embodiment, the present invention provides a method of cleaning contact lenses comprising dissolving a tablet consisting essentially of a basic effervescent component and an acidic effervescent component in an aqueous composition at a pH of less than about 7.5 such that a cleansing amount of carbon dioxide and carbonic acid are produced and contacting the contact lens with the carbon dioxide and carbonic acid, wherein the tablet optionally contains one or more ingredients selected from the group consisting of fillers, lubricating agents, bulking agents and tonicity agents, but does not contain polymeric beads, an enzyme, a cleansing amount of a surfactant, or a disinfecting amount of hydrogen peroxide.

Alternatively, a simple, one-step cleaning and disinfecting regimen is obtained when the effervescent tablet compositions of the present invention are dissolved in an aqueous composition selected from the group consisting of disinfecting solutions and rinsing/disinfecting/storage solutions, instead of a purified water or a simple saline solution as described above. Suitable disinfectants include polyquaternium-1, the disinfectant contained in Opti-Free® Rinsing, Disinfecting & Storage Solution, but do not include hydrogen peroxide. Accordingly, the compositions of the present invention do not include a disinfecting amount (e.g., about 0.01 to less than 0.5% w/v) of hydrogen peroxide, nor are they combined with aqueous compositions comprising a disinfecting amount of hydrogen peroxide.

The following examples are presented to illustrate various aspects of the present invention, but are not intended to limit the scope of the invention in any respect.

Tableting Procedure: All tablets referred to in the examples presented below were prepared according to the following procedure in 20% or lower humidity conditions:

a) The formulation ingredients were weighed, sized using an oscillating granulator with a suitable mesh screen (18–40 mesh), and blended using a twin shell Patterson-Kelly blender for 30 minutes.

b) Tablets were compressed using a 3/16" diameter tablet tooling on a Stokes B-2 tablet press.

c) The tablets weighed an average of 73 mg/tablet, with a hardness of about 5.0–7.0 Strong Cobb Units.

d) Tablet disintegration time was measured in purified water and found to be about 35–45 seconds for each of the tablets mentioned in Examples 1 and 2.

Cleaning Efficacy

Cleaning efficacy was determined using soiled contact lenses. Soiled lenses were obtained from two sources: (1) human study participants ("human-worn lenses") and (2) a laboratory where lysozyme, mucin and lipids were intentionally deposited upon the lenses ("laboratory deposited lenses").

Cleanliness of the lenses was evaluated as follows. The loosely-bound deposits on soiled lenses were removed by gently rubbing both surfaces of the lenses with Unisol Plus® saline solution in the palm of a hand. The lenses were then visually examined for remaining deposits and rated according to the Rudko system for classification of lens deposits. See Table 1 below (Equipment: Bausch and Lomb tweezers; Bausch and Lomb spotlight; Sorgs lint-free towel; and Vigor measuring magnifier 7×#EL470).

TABLE 1

Rudko Lens Deposit Classification System

| Class | Heaviness of Deposit |
|---|---|
| I | Clean |
| II | Visible under oblique light when wet or dry using 7x magnification |
| III | Visible when dry with the unaided eye |
| IV | Visible when wet with the unaided eye |
| **Class** | **Type of Deposit** |
| C | Crystalline |
| G | Granular |
| F | Filmy |
| **Class** | **Extent of Deposit** |
| A | 0–25% of lens |
| B | 25–50% of lens |
| C | 50–75% of lens |
| D | 75–100% of lens |

Definitions

C: Crystalline deposits comprised of crystal groups which may be scattered or layered and are usually iridescent, depending upon the illumination.

G: Granular deposits consisting of fine granulation, usually in mass form.

F: Film and hazes consisting of castings which are not granular or crystalline. The hazes often have a bluish tint.

After their initial cleanliness evaluation, the lenses were soaked in the designated cleaning solution for the indicated period of time (30, 60, 120 or 240 minutes) and again rated for deposits according to the cleanliness evaluation system described above. The lenses which were not cleaned after 1 hour were exposed to same cleaning solution for additional time (2 and 4 hrs), and rated again.

Example 1: Preparation of Citric Acid/Sodium Bicarbonate Tablets.

Effervescent tablets were formulated according to the procedures described above using following ingredients:

| Ingredients | mg/Tablet | Gm/10,000 Tablets |
|---|---|---|
| *Citric Acid, USP, Anhydrous | 21.0 | 210.0 |
| *Sodium Bicarbonate, USP, Powder | 48.0 | 480.0 |
| **Polyethylene Glycol, 3350, USP, Fine Powder | 4.0 | 40.0 |
| Total | 73.0*** | 730.0 |

*Effervescent components

**Tablet Lubricant

***Theoretically, 73 mg effervescent tablet gives 25 mg of carbon dioxide

Example 2: Preparation of Adipic Acid/Sodium Bicarbonate Tablets.

Effervescent tablets were formulated according to the procedures described above using following ingredients:

| Ingredients | mg/Tablet | Gm/10,000 Tablets |
|---|---|---|
| *Adipic Acid, N.O.C. | 38.6 | 386 |
| *Sodium Bicarbonate, USP, Powder | 34.4 | 344 |
| Total | 73.0** | 730.0 |

*Effervescent components

**Theoretically, 73 mg effervescent tablet gives 25 mg of carbon dioxide

Example 3: Preparation of Sodium Citrate Solution.

A cleaning solution was formulated using following ingredients:

| Ingredients | amount |
|---|---|
| Sodium Citrate | 2 g |
| Purified Water | q.s. to 100 mL |

Example 4: Disintegration Time and Solution pH for Tablets of Example 1.

The disintegration time and pH of solution were determined after dissolving one and two tablets of Example 1, respectively, in separate vials each containing 5 mL of purified water. The results are shown in Table 2 below.

TABLE 2

| 1 Tablet in 5 mL Diluent | | | 2 Tablets in 5 mL Diluent | | |
|---|---|---|---|---|---|
| Observation # | Disintegration Time (sec) | pH | Observation # | Disintegration Time (sec) | pH |
| 1 | 35 | 6.65 | 1 | 35, 35 | 6.54 |
| 2 | 36 | 6.43 | 2 | 38, 40 | 6.50 |
| 3 | 37 | 6.63 | 3 | 42, 42 | 6.53 |
| 4 | 40 | 6.37 | 4 | 40, 42 | 6.54 |
| 5 | 40 | 6.38 | 5 | 40, 40 | 6.55 |

Example 5: Cleaning Efficacy of Tablets of Example 1 (1 Tablet/5 mL Diluent).

The cleaning efficacy of the citric acid/sodium bicarbonate tablets of Example 1 was eluated by placing one 73 mg tablet into 5 mL of diluent (purified water). Theoretically, a 73 mg tablet gives 25 mg of carbon dioxide. After the tablet was dissolved, soiled human worn soft contact lenses were rated and placed in the solution. After soaking in the solution for one hour, the lenses were rated again. If the lens not cleaned after one hour, the lens was returned to the solution for an additional hour. If the lens was not cleaned after the second hour, the lens was returned to the solution for an additional two hours and evaluated again. Eight soft contact lenses were evaluated. The results are presented below in Table 3.

TABLE 3

Cleaning Efficacy of Citric Acid/Sodium Bicarbonate Tablets (1 Tablet/5 mL Diluent) With Soiled Human Worn Soft Contact Lenses

| | | | Cleanliness Rating | | | |
|---|---|---|---|---|---|---|
| | | | | After Cleaning | | |
| Lens # | Lens Type | Lens Age | Before Cleaning | 1 Hr | 2 Hr | 4 Hr |
| 1 | Group II | 2 years | IIIFA | IIIFA | I | — |
| 2 | Group II | 2 years | IIIFC | IIIFA | I | — |
| 3 | Group II | 6 months | IIIFC | IIIFA | I | — |
| 4 | Group II | 6 months | IIIFB | IIIFA | IIIFA | I |
| 5 | Group IV | 8 months | IIIFC | IIIFC | I | — |
| 6 | Group IV | 8 months | IIIFB | IIIFB | I | — |
| 7 | Group IV | 6 months | IIIFA | IIIFA | I | — |
| 8 | Group IV | 6 months | IIIFA | IIIFA | I | — |

Example 6: Cleaning Efficacy of Tablets of Example 1 (2 Tablets/5 mL Diluent).

The cleaning efficacy of the citric acid/sodium bicarbonate tablets of Example 1 was evaluated as described in Example 5 above, except that in this case two 73 mg tablets were placed into 5 mL of diluent (purified water). Theoretically, two 73 mg tablets give 50 mg of carbon dioxide. Twelve soft contact lenses were evaluated. The results are shown in Table 4 below.

TABLE 4

Cleaning Efficacy of Citric Acid/Sodium Bicarbonate Tablets (2 Tablets/5 mL Diluent) With Soiled Human Worn Soft Contact Lenses

| | | | Cleanliness Rating | | | |
|---|---|---|---|---|---|---|
| | | | | After Cleaning | | |
| Lens # | Lens Type | Lens Age | Before Cleaning | 1 Hr | 2 Hr | 4 Hr |
| 1 | Group IV | 6 months | IIIFC | IIIFA | I | — |
| 2 | Group IV | 6 months | IIIFB | I | — | |
| 3 | Group I | 6 months | IIIFC | IIIFA | I | — |
| 4 | Group I | 6 months | IIIFB | IIIFA | I | — |
| 5 | Group IV | 2 months | IVFD | I | — | |
| 6 | Group IV | 2 months | IVFD | I | — | |
| 7 | Group I | 6 months | IIIFA | I | — | |
| 8 | Group I | 6 months | IIIFC | I | — | |
| 9 | Group I | 12 months | IIIFA | IIIFA | I | — |
| 10 | Group I | 12 months | IIIFA | I | — | |
| 11 | Group IV | 6 months | IIIFB | I | — | |
| 12 | Group IV | 6 months | IIIFB | I | — | |

Example 7: Cleaning Efficacy of Tablets of Example 1 (3 Tablets/5 mL Diluent).

The cleaning efficacy of the citric acid/sodium bicarbonate tablets of Example 1 was evaluated as described in Example 5 above, except that in this case three 73 mg tablets were placed into 5 mL of diluent (purified water). Theoretically, three 73 mg tablets give 75 mg of carbon dioxide. Four soft contact lenses were evaluated. The results are shown in Table 5 below.

TABLE 5

Cleaning Efficacy of Citric Acid/Sodium Bicarbonate Tablets (3 Tablets/5 mL Diluent) With Soiled Human Worn Soft Contact Lenses

| | | | Cleanliness Rating | | | |
|---|---|---|---|---|---|---|
| | | | | After Cleaning | | |
| Lens # | Lens Type | Lens Age | Before Cleaning | 1 Hr | 2 Hr | 4 Hr |
| 1 | Group I | 6 months | IIIFA | I | — | |
| 2 | Group I | 6 months | IIIFC | I | — | |
| 3 | Group I | 6 months | IIIFD | I | — | |
| 4 | Group I | 6 months | IIIFB | I | — | |

Example 8: Cleaning Efficacy of Tablets of Example 1(1 Tablet/5 mL Diluent).

The cleaning efficacy of the citric acid/sodium bicarbonate tablets of Example 1 was evaluated as described in Example 5 above, except that in this case six soiled human worn rigid gas permeable contact lenses were evaluated. The results are shown in Table 6 below.

TABLE 6

Cleaning Efficacy of Citric Acid/Sodium Bicarbonate Tablets (1 Tablet/5 mL Diluent) With Soiled Human Worn Rigid Gas Permeable Lenses

| | | | Cleanliness Rating | | | |
|---|---|---|---|---|---|---|
| | | | | After Cleaning | | |
| Lens # | Lens Type | Lens Age | Before Cleaning | 1 Hr | 2 Hr | 4 Hr |
| 1 | RGP | 12 months | IIIFB | IIIFA | I | — |
| 2 | RGP | 6 months | IIIFC | I | — | |
| 3 | RGP | 6 months | IIIFD | I | — | |
| 4 | RGP | 6 months | IIIFA | I | — | |
| 5 | RGP | 3 months | IIIFA | I | — | |
| 6 | RGP | 3 months | IIIFA | I | — | |

Example 9: Cleaning Efficacy of Tablets of Example 1(2 Tablets/5 mL Diluent).

The cleaning efficacy of the citric acid/sodium bicarbonate tablets of Example 1 was evaluated as described in Example 6 above, except that in this case soiled human worn rigid gas permeable contact lenses were evaluated. Four lenses were evaluated. The results are shown in Table 7 below.

TABLE 7

Cleaning Efficacy of Citric Acid/Sodium Bicarbonate Tablets (2 Tablets/5 mL Diluent) With Soiled Human Worn Rigid Gas Permeable Lenses

| | | | Cleanliness Rating | | | |
|---|---|---|---|---|---|---|
| | | | | After Cleaning | | |
| Lens # | Lens Type | Lens Age | Before Cleaning | 1 Hr | 2 Hr | 4 Hr |
| 1 | RGP | 6 months | IIIFA | I | — | |
| 2 | RGP | 12 months | IIIFA | I | — | |
| 3 | RGP | 12 months | IIIFA | I | — | |
| 4 | RGP | 12 months | IIIFA | I | — | |

Example 10: Cleaning Efficacy of Tablets of Example 2(2 Tablets/5 mL Diluent).

The cleaning efficacy of the adipic acid/sodium bicarbonate tablets of Example 2 was evaluated by placing two 73 mg tablets into 5 mL of diluent (Unisol Plus Saline Solution). Theoretically, two 73 mg tablets give 50 mg of carbon dioxide. After the tablets dissolved, soiled human worn soft contact lenses or laboratory deposited soft contact lenses were placed in the solution and evaluated after soaking for one hour. Ten lenses were evaluated. After one hour of soaking, all ten lenses were effectively cleaned. The results are presented below in Table 8.

TABLE 8

Cleaning Efficacy of Adipic Acid/Sodium Bicarbonate Tablets (2 Tablets/5 mL Diluent) With Soiled Human Worn and Laboratory Deposited Soft Contact Lenses

| Lens | Cleanliness Rating | | | |
|---|---|---|---|---|
| | Before Cleaning | After Cleaning | | |
| # | Initial | 30 Min | 60 Min | 120 Min |
| Human Worn Soft Lenses | | | | |
| 5 | IIIFB | IIIFA | I | — |
| 6 | IIIFA | IIIFA | I | — |
| 7 | IIIFB | IIIFA | I | — |
| 8 | IIIFB | IIIFA | I | — |
| 24 | IVFC | IIIFB | I | — |
| 25 | IVFC | IIIFA | I | — |
| 26 | IVFD | IIIFB | I | — |
| Laboratory Deposited Soft Lenses | | | | |
| 1 | IVFD | IIIFA | I | — |
| 2 | IVFD | IIIFB | I | — |
| 3 | IVFC | IIIFA | I | — |

Example 11: Cleaning Efficacy of Tablets of Example 2(with $CO_2$ Removed from Solution).

The experiment of Example 10 above was repeated, except that the $CO_2$ was removed from the solution prior to exposing the soiled lenses to the solution. Cleaning solutions were prepared by dissolving two tablets of Example 2 in 5 mL of Unisol Plus Saline Solution. The cleaning solutions were then heated in a microwave oven at low setting for 2 minutes to remove $CO_2$. The soiled lenses (human worn and lab deposited) were then soaked in the cleaning solution for the designated time and rated. The results, shown below in Table 9, for the eight lenses evaluated show no cleaning after 120 minutes.

TABLE 9

Cleaning Efficacy of Adipic Acid/Sodium Bicarbonate Tablets (After $CO_2$ Removed) With Soiled Human Worn and Laboratory Deposited Soft Contact Lenses

| Lens | # of | Cleanliness Rating | | | |
|---|---|---|---|---|---|
| | | Before Cleaning | | After Cleaning | |
| # | Tablets | Initial | 30 Min | 60 Min | 120 Min |
| Human Worn Soft Lenses | | | | | |
| 9 | 2 | IVFD | IVFD | IVFD | IVFD |
| 10 | 2 | IIIFB | IIIFB | IIIFB | IIIFB |
| 11 | 2 | IIIFA | IIIFA | IIIFA | IIIFA |
| 12 | 2 | IIIFA | IIIFA | IIIFA | IIIFA |
| 30 | 2 | IVFC | IVFC | IVFC | IVFC |
| 31 | 2 | IVFD | IVFD | IVFD | IVFD |
| Laboratory Deposited Soft Lenses | | | | | |
| 9 | 2 | IVFD | IVFD | IVFD | IVFD |
| 10 | 2 | IVFD | IVFD | IVFD | IVFD |

Example 12: Cleaning Efficacy of Tablets of Example 1 in Saline Solution (2 Tablets/5 mL Diluent).

The cleaning efficacy of the citric acid/sodium bicarbonate tablets of Example 1 was evaluated as described in Example 6 above, except that in this case the cleaning solutions were prepared by dissolving two tablets of Example 1 in 5 mL of diluent (Unisol Plus Saline Solution). A total of ten soiled (human worn and laboratory deposited) soft contact lenses were evaluated. The results are shown in Table 10 below. All ten lenses were cleaned within 60 minutes.

TABLE 10

Cleaning Efficacy of Citric Acid/Sodium Bicarbonate Tablets (2 Tablets/5 mL Diluent) With Soiled Human Worn Soft Contact Lenses

| Lens | # of | Cleanliness Rating | | | |
|---|---|---|---|---|---|
| | | Before Cleaning | | After Cleaning | |
| # | Tablets | Initial | 30 Min | 60 Min | 120 Min |
| Human Worn Soft Lenses | | | | | |
| 1 | 2 | IIIFA | IIIFA | I | — |
| 2 | 2 | IIIFA | IIIFA | I | — |
| 3 | 2 | IIIFB | IIIFA | I | — |
| 4 | 2 | IIIFB | IIIFA | I | — |
| 27 | 2 | IVFC | IIIFA | I | — |
| 28 | 2 | IVFD | IIIFB | I | — |
| 29 | 2 | IVFD | IIIFA | I | — |
| Laboratory Deposited Soft Lenses | | | | | |
| 4 | 2 | IVFD | IIIFA | I | — |
| 5 | 2 | IVFD | IIIFA | I | — |
| 6 | 2 | IVFC | IIIFA | I | — |

Example 13: Cleaning Efficacy of Tablets of Example 1(with $CO_2$ Removed from Solution).

The experiment of Example 12 above was repeated, except that the $CO_2$ was removed from the cleaning solution prior to exposing the soiled lenses to the solution. Cleaning solutions were prepared by dissolving two tablets of Example 1 in 5 mL of Unisol Plus Saline Solution. The cleaning solutions were then heated in a microwave oven at low setting for 2 minutes to remove $CO_2$. The soiled lenses (human worn and lab deposited) were then soaked in the cleaning solution for the designated time and rated. The results, shown below in Table 11, for the eight lenses evaluated show essentially no cleaning after 120 minutes.

TABLE 11

Cleaning Efficacy of Citric Acid/Sodium Bicarbonate Tablets (After $CO_2$ Removed) With Soiled Human Worn and Laboratory Deposited Soft Contact Lenses

| Lens | # of | Cleanliness Rating | | | |
|---|---|---|---|---|---|
| | | Before Cleaning | | After Cleaning | |
| # | Tablets | Initial | 30 Min | 60 Min | 120 Min |
| Human Worn Soft Lenses | | | | | |
| 13 | 2 | IIIFB | IIIFB | IIIFB | IIIFB |
| 14 | 2 | IIIFB | IIIFB | IIIFB | IIIFA |
| 15 | 2 | IIIFB | IIIFB | IIIFB | IIIFB |
| 16 | 2 | IIIFB | IIIFB | IIIFB | IIIFB |
| 32 | 2 | IVFD | IVFB | IVFD | IVFD |
| 33 | 2 | IVFC | IVFB | IVFB | IVFB |
| Laboratory Deposited Soft Lenses | | | | | |
| 7 | 2 | IVFC | IVFC | IVFC | IVFC |
| 8 | 2 | IVFD | IVFD | IVFD | IVFD |

Example 14: Cleaning Efficacy of Sodium Citrate Solution of Example 3.

The cleaning efficacy of the cleaning solution of Example 3 was evaluated as follows. Eleven soiled lenses (human worn) were rated for deposits, then soaked in the cleaning solution for the designated time and rated again. The results, shown below in Table 12 show no effective cleaning after 120 minutes.

TABLE 12

Cleaning Efficacy of Sodium Citrate Solution With Soiled Human Worn Soft Contact Lenses

| Lens | Cleanliness Rating: Before Cleaning | After Cleaning | | |
|---|---|---|---|---|
| # | Initial | 30 Min | 60 Min | 120 Min |
| Human Worn Soft Lenses | | | | |
| 17 | IIIFB | IIIFB | IIIFB | IIIFB |
| 18 | IIIFB | IIIFB | IIIFB | IIIFB |
| 19 | IVFD | IVFD | IVFC | IVFC |
| 20 | IIIFB | IIIFB | IIIFB | IIIFB |
| 21 | IIIFB | IIIFB | IIIFB | IIIFB |
| 22 | IIIFB | IIIFB | IIIFB | IIIFB |
| 23 | IIIFA | IIIFA | IIIFA | IIIFA |
| 1A | IIIFC | IIIFC | IIIFC | IIIFC |
| 2A | IIIFB | IIIFB | IIIFB | IIIFB |
| 3A | IVFD | IIIFD | IIIFD | IIIFD |
| 4A | IVFC | IVFC | IVFC | IVFC |

Example 15: Recleaning of Laboratory Deposited Soft Lenses with Tablet of Example 1.

Soiled (laboratory deposited) lenses #7 and #8 (Table 11) in Example 13 above which were not cleaned when exposed to a cleaning solution prepared by dissolving two tablets of Example 1 in 5 mL of Unisol Plus Saline Solution and then eliminating the $CO_2$ by heating in a microwave oven on a low setting for two minutes, were recleaned by subjecting them to a cleaning solution prepared by dissolving one tablet of Example 1 in 5 mL of Unisol Plus Saline Solution. As shown in Table 13 below, both lenses were effectively cleaned after 120 minutes. This experiment demonstrates that the presence of $CO_2$ is necessary for effective cleaning of soiled lenses.

TABLE 13

Recleaning of Soiled (Laboratory Deposited) Soft Contact Lenses Using Tablet of Example 1 (1 Tablet/5 mL Diluent).

| Lens | Cleanliness Rating: Before Cleaning | After Cleaning | | |
|---|---|---|---|---|
| # | Initial | 30 Min | 60 Min | 120 Min |
| 7 | IVFC | IIIFC | IIIFC | I |
| 8 | IVFD | IIIFB | IIIFB | I |

Example 16: Recleaning of Laboratory Deposited Soft Lenses with Tablet of Example 2.

Soiled (laboratory deposited) lenses #9 and #10 (Table 9) in Example 11 above which were not cleaned when exposed to a cleaning solution prepared by dissolving two tablets of Example 2 in 5 mL of Unisol Plus Saline Solution and then eliminating the $CO_2$ by heating in a microwave oven on a low setting for two minutes, were recleaned by subjecting them to a cleaning solution prepared by dissolving one tablet of Example 2 in 5 mL of Unisol Plus Saline Solution. As shown in Table 14 below, both lenses were effectively cleaned after 120 minutes. This experiment demonstrates that the presence of $CO_2$ is necessary for effective cleaning of soiled lenses.

TABLE 14

Recleaning of Soiled (Laboratory Deposited) Soft Contact Lenses Using Tablet of Example 2 (1 Tablet/5 mL Diluent).

| Lens | Cleanliness Rating: Before Cleaning | After Cleaning | | |
|---|---|---|---|---|
| # | Initial | 30 Min | 60 Min | 120 Min |
| 9 | IVFD | IIIFD | IIIFA | I |
| 10 | IVFD | IIIFB | IIIFB | I |

Example 17: Recleaning of Human Worn Soft Lenses with Tablet of Example 1.

Soiled (human worn) lenses #17–22 (Table 12) in Example 14 above which were not cleaned when exposed to the sodium citrate cleaning solution of Example 3, were recleaned by subjecting to them to a cleaning solution prepared by dissolving two tablets of Example 1 in 5 mL of Unisol Plus Saline Solution. As shown in Table 15 below, most lenses were effectively cleaned after 60 minutes and all lenses were effectively cleaned after 120 minutes. This experiment demonstrates that the presence of $CO_2$ is necessary for effective cleaning of soiled lenses.

TABLE 15

Recleaning of Soiled (Human Worn) Soft Contact Lenses Using Tablet of Example 1 (2 Tablets/5 mL Diluent).

| Lens | Cleanliness Rating: Before Cleaning | After Cleaning | | |
|---|---|---|---|---|
| # | Initial | 30 Min | 60 Min | 120 Min |
| 17 | IIIFB | IIIFA | I | — |
| 18 | IIIFB | IIIFA | I | — |
| 19 | IVFD | IIIFC | IIIFA | I |
| 20 | IIIFB | IIIFA | I | — |
| 21 | IIIFB | IIIFA | I | — |
| 22 | IIIFB | IIIFA | I | — |

Example 18: Recleaning of Human Worn Soft Lenses with Tablet of Example 2.

Soiled (human worn) lenses #23 and 1A–4A (Table 12) in Example 14 above which were not cleaned when exposed to the sodium citrate cleaning solution of Example 3, were recleaned by subjecting them to a cleaning solution prepared by dissolving two tablets of Example 2 in 5 mL of Unisol Plus Saline Solution. As shown in Table 15 below, most lenses were effectively cleaned after 60 minutes and all lenses were effectively cleaned after 120 minutes. This experiment demonstrates that the presence of $CO_2$ is necessary for effective cleaning of soiled lenses.

TABLE 16

Recleaning of Soiled (Human Worn) Soft Contact Lenses Using Tablet of Example 2 (2 Tablets/5 mL Diluent).

| Lens | Cleanliness Rating | | | |
|---|---|---|---|---|
| | Before Cleaning | After Cleaning | | |
| # | Initial | 30 Min | 60 Min | 120 Min |
| 23 | IIIFA | I | — | — |
| 1A | IIIFC | IIIFC | IIIFC | I |
| 2A | IIIFB | IIIFA | I | — |
| 3A | IIIFD | IIIFA | I | — |
| 4A | IVFC | IIIFB | I | — |

Example 19: Normalization of Cleaning Data for Human Worn Soft Contact Lenses #17–22.

For comparison purposes, the cleaning results for soiled (human worn) soft contact lenses #17–22 in Table 12 were normalized with the data in Table 15. In order to plot the cleaning efficacy data against time, the lens deposit rating obtained using the Rudko rating system (Tables 12 and 15) was converted to a numerical rating using the conversion key shown below in Table 17. The number assigned for each Rudko rating for each lens was added for each time interval and the data normalized by dividing with highest number. The normalized data for cleaning efficacy with 2% Sodium Citrate Solution of Example 3 and cleaning efficacy with the citric acid/sodium bicarbonate tablets of Example 1 appears in Table 18 below and is summarized in FIG. 1. This normalized data illustrates that complete, effective cleaning was achieved with the $CO_2$-containing solution in two hours. However, most of the lenses were cleaned in one hour. In the absence of carbon dioxide, no cleaning was achieved. This is also evident from the data shown in Table 11.

TABLE 17

Rudko Lens Deposit Classification System
Conversion of Rudko Deposit Classification to Numerals

| Rudko Classification | Numeral Assigned |
|---|---|
| I - Clean Lens | 0.00 |
| IIFA | 1.25 |
| IIFB | 1.50 |
| IIFC | 1.75 |
| IIFD | 2.00 |
| IIIFA | 2.25 |
| IIIFB | 2.50 |
| IIIFC | 2.75 |
| IIIFD | 3.00 |
| IVFA | 3.25 |
| IVFB | 3.50 |
| IVFC | 3.75 |
| IVFD | 4.00 |

TABLE 18

Numerical Equivalent of Rudko Rating for Cleaning Efficacy Data (Human Worn Lenses # 17–22)

| Lens # | Before Cleaning | After Cleaning | | |
|---|---|---|---|---|
| | Initial | 30 Min | 60 Min | 120 Min |
| Data from Table 12 (Without $CO_2$) | | | | |
| 17 | 2.50 | 2.50 | 2.50 | 2.50 |
| 18 | 2.50 | 2.50 | 2.50 | 2.50 |
| 19 | 4.00 | 4.00 | 3.75 | 3.75 |
| 20 | 2.50 | 2.50 | 2.50 | 2.50 |
| 21 | 2.50 | 2.50 | 2.50 | 2.50 |
| 22 | 2.50 | 2.50 | 2.50 | 2.50 |
| Total | 16.50 | 16.50 | 16.25 | 16.25 |
| Normalized | 1.00 | 1.00 | 0.985 | 0.985 |
| Data from Table 15 (With $CO_2$) | | | | |
| 17 | 2.50 | 2.25 | 0.0 | — |
| 18 | 2.50 | 2.25 | 0.0 | — |
| 19 | 4.00 | 2.75 | 2.25 | 0.0 |
| 20 | 2.50 | 2.25 | 0.0 | 0.0 |
| 21 | 2.50 | 2.25 | 0.0 | 0.0 |
| 22 | 2.50 | 2.25 | 0.0 | 0.0 |
| Total | 16.50 | 14.00 | 2.25 | 0.0 |
| Normalized | 1.00 | 0.848 | 0.136 | 0 |

Example 20: Osmolality and pH Measurements.

Fresh samples of various cleaning solutions were prepared and their osmolality and pH determined. Osmolality and pH of Unisol Plus were also determined as a control. The data is shown below in Table 19.

TABLE 19

Osmolality and pH Measurements

| # | Sample | Osmolality mOsm/Kg | pH |
|---|---|---|---|
| 1. | Unisol Plus Saline Solution | 300 | 7.38 |
| 2. | 2% Sodium Citrate in Purified Water (Ex. 3) | 186 | 7.85 |
| 3. | Two Adipic Acid Based Tablets (Ex. 2) dissolved in 5 mL of Unisol Plus | 568 | 5.32 |
| 4. | Two Citric Acid Based Tablets (Ex. 1) dissolved in 5 mL of Unisol Plus | 616 | 7.02 |
| | One Adipic Acid Based Tablet (Ex. 2) dissolved in 5 mL of Unisol Plus | 441 | 5.33 |
| 6. | One Citric Acid Based Tablet (Ex. 1) dissolved in 5 mL of Unisol Plus | 461 | 7.09 |
| 7. | Two Adipic Acid Based Tablets (Ex. 2) dissolved in 5 mL of Unisol Plus and heated to remove $CO_2$ | 637 | 5.16 |
| 8. | Two Citric Acid Based Tablets (Ex. 1) dissolved in 5 mL of Unisol Plus and heated to remove $CO_2$ | 646 | 8.11 |

The invention has been described by reference to certain preferred embodiments; however, it should be understood that it may be embodied in other specific forms or variations thereof without departing from its spirit or essential characteristics. The embodiments described above are therefore considered to be illustrative in all respects and not restrictive, the scope of the invention being indicated by the appended claims rather than by the foregoing description.

What is claimed is:

1. A method of cleaning a soiled contact lens comprising contacting the soiled lens with a composition having a pH of less than about 7.5 comprising a cleansing amount of carbon dioxide and carbonic acid for a time sufficient to clean the soiled lens, wherein the composition excludes polymeric beads, an enzyme, a cleansing amount of a surfactant, and a disinfecting amount of hydrogen peroxide.

2. The method of claim 1 wherein the method comprises the steps of dissolving an effervescent tablet composition capable of generating a cleansing amount of carbon dioxide and carbonic acid in an aqueous composition having a pH of less than about 7.5 to form a cleaning solution, and contacting the soiled lens with the cleaning solution for a time sufficient to clean the soiled lens, wherein the effervescent tablet composition excludes polymeric beads, an enzyme, a cleansing amount of a surfactant, and a disinfecting amount of hydrogen peroxide.

3. The method of claim 2 wherein the effervescent tablet composition comprises a basic effervescent component selected from the group of alkali carbonate compounds and an acidic effervescent component selected from the group consisting of organic and inorganic acidic compounds.

4. The method of claim 3 wherein the effervescent tablet composition comprises a basic effervescent component selected from the group consisting of sodium carbonate, sodium bicarbonate, glycine carbonate, potassium carbonate, potassium bicarbonate, potassium dihydrogencitrate, and calcium carbonate; and an acidic effervescent component selected from the group consisting of citric acid, adipic acid, tartaric acid, maleic acid, boric acid, benzoic acid, hydroxybenzoic acid, methoxybenzoic acid, mandelic acid, malonic acid, lactic acid, pyruvic acid, glutaric acid, aspartic acid, hydrochloric acid, oxalic acid, salicylic acid, succinic acid, and acetic acid.

5. The method of claim 4 wherein the basic effervescent component is sodium bicarbonate and the acidic effervescent component is selected from the group consisting of citric acid, adipic acid and combinations of citric and adipic acids.

6. The method of claim 5 wherein the acidic effervescent component is citric acid, and wherein the amount of basic effervescent component is from about 10 to 200 mg and the amount of acidic effervescent component is from about 5 to 65 mg.

7. The method of claim 3 wherein the effervescent tablet composition further comprises one or more additional ingredients selected from the group consisting of fillers; lubricating agents; bulking agents; and tonicity agents.

8. The method of claim 7 wherein the additional ingredients are selected from the group consisting of sodium chloride; mannitol; sorbitol; glucose; fructose; compressible sugar; lactose anhydrous; lactose; polyethylene glycol 3,350; polyethylene glycol 8,000; sodium benzoate; vegetable oils; talc; boric acid; and sodium borate.

9. The method of claim 8 wherein the effervescent tablet composition comprises about 21 mg of citric acid, about 48 mg of sodium bicarbonate and about 4 mg of polyethylene glycol 3,350.

10. The method of claim 3 wherein the effervescent tablet composition comprises about 38.6 mg of adipic acid and about 34.4 mg of sodium bicarbonate.

11. The method of claim 1 wherein the aqueous composition is selected from the group consisting of purified water; saline solutions; disinfecting solutions; and rinsing/disinfecting/storage solutions; provided that the aqueous composition does not contain a disinfecting amount of hydrogen peroxide.

12. The method of claim 11 wherein the aqueous composition is a disinfecting solution.

13. A method of simultaneously cleaning and disinfecting a contact lens comprising the steps of a) forming a cleaning and disinfecting solution by dissolving an effervescent tablet capable of generating a cleansing amount of carbon dioxide and carbonic acid in an aqueous composition comprising a disinfectant, wherein the cleaning and disinfecting solution has a pH of less than about 7.5 and excludes polymeric beads, an enzyme, a cleansing amount of a surfactant, and a disinfecting amount of hydrogen peroxide; and b) contacting the contact lens with the cleaning and disinfecting solution for a time sufficient to clean and disinfect the lens.

* * * * *